US012708980B2

(12) United States Patent
Kawasaki

(10) Patent No.: US 12,708,980 B2
(45) Date of Patent: Aug. 18, 2026

(54) POLISHING HEAD, POLISHING APPARATUS, AND ELASTIC BODY

(71) Applicant: Kioxia Corporation, Tokyo (JP)

(72) Inventor: Tomonori Kawasaki, Yokkaichi (JP)

(73) Assignee: Kioxia Corporation, Tokyo (JP)

( * ) Notice: Subject to any disclaimer, the term of this patent is extended or adjusted under 35 U.S.C. 154(b) by 445 days.

(21) Appl. No.: 18/462,655

(22) Filed: Sep. 7, 2023

(65) Prior Publication Data

US 2024/0181595 A1 Jun. 6, 2024

(30) Foreign Application Priority Data

Dec. 6, 2022 (JP) ..... 2022-194620

(51) Int. Cl.
*B24B 37/10* (2012.01)
*B24B 37/30* (2012.01)

(52) U.S. Cl.
CPC ..... *B24B 37/107* (2013.01); *B24B 37/30* (2013.01)

(58) Field of Classification Search
CPC ..... B24B 37/30; B24B 37/32; B24B 37/27; B24B 37/005; B24B 41/005; B24B 41/06; B24B 41/061; B24B 7/228; B24B 49/16
USPC ..... 451/41, 287, 288, 398
See application file for complete search history.

(56) References Cited

U.S. PATENT DOCUMENTS 6,863,771 B2 * 3/2005 Brown ..... B24B 1/005 451/41
7,465,668 B2 12/2008 Fukushima et al.
9,399,277 B2 * 7/2016 Yoshida ..... H01L 21/67742
2016/0193712 A1 * 7/2016 Komura ..... B24B 37/30 451/287
2020/0094371 A1 * 3/2020 Akazawa ..... B24B 37/105
2021/0269610 A1 * 9/2021 Yasuda ..... C08J 7/02
2023/0381910 A1 * 11/2023 Saito ..... B24B 37/005

FOREIGN PATENT DOCUMENTS

JP 2002079454 A * 3/2002
JP 2006-237445 A 9/2006
JP 2009-200068 A 9/2009
(Continued)

OTHER PUBLICATIONS

Machine translation of JP-2002079454-A (Year: 2002).*

*Primary Examiner* — Robert F Neibaur
(74) *Attorney, Agent, or Firm* — Maier & Maier, PLLC

(57) ABSTRACT

According to one embodiment, a polishing head includes: a head body disposed to face a polishing pad for polishing a surface to be polished of a substrate to be processed, the head body being capable of rotating the substrate to be processed with respect to the polishing pad; a plurality of substrate pressing parts provided concentrically on a surface of the head body on a polishing pad side, the substrate pressing parts being independently displaceable with respect to the polishing pad with a pressure change of contained gas; and an elastic body provided between the surface to be polished and surfaces of the plurality of substrate pressing parts on the polishing pad side, the elastic body being capable of holding the substrate to be processed on a substrate holding surface facing the polishing pad. The substrate holding surface of the elastic body fits inside a range facing an outermost peripheral substrate pressing part among the plurality of substrate pressing parts.

15 Claims, 10 Drawing Sheets

(56) References Cited

FOREIGN PATENT DOCUMENTS

| | | | |
|---|---|---|---|
| JP | 2009-224702 | A | 10/2009 |
| JP | 4469737 | B2 | 5/2010 |
| JP | 5210444 | B1 | 6/2013 |

* cited by examiner

POLISHING HEAD, POLISHING APPARATUS, AND ELASTIC BODY

CROSS-REFERENCE TO RELATED APPLICATIONS

This application is based upon and claims the benefit of priority from Japanese Patent Application No. 2022-194620, filed on Dec. 6, 2022; the entire contents of which are incorporated herein by reference.

FIELD

Embodiments described herein relate generally to a polishing head, a polishing apparatus, and an elastic body.

BACKGROUND

In a process for manufacturing a semiconductor device, a chemical mechanical polishing (hereinafter, referred to as CMP) method has mainly been used to obtain flatness of a substrate. In the CMP method, polishing is performed by rotating a substrate while pressing the substrate against a polishing surface.

At this time, an end of the substrate may be excessively polished. Thus, the flatness of the substrate is not secured in some cases.

DETAILED DESCRIPTION

In general, according to one embodiment, a polishing head includes: a head body disposed to face a polishing pad for polishing a surface to be polished of a substrate to be processed, the head body being capable of rotating the substrate to be processed with respect to the polishing pad; a plurality of substrate pressing parts provided concentrically on a surface of the head body on a polishing pad side, the substrate pressing parts being independently displaceable with respect to the polishing pad with a pressure change of contained gas; and an elastic body provided between the surface to be polished and surfaces of the plurality of substrate pressing parts on the polishing pad side, the elastic body being capable of holding the substrate to be processed on a substrate holding surface facing the polishing pad. The substrate holding surface of the elastic body fits inside a range facing an outermost peripheral substrate pressing part among the plurality of substrate pressing parts.

Exemplary embodiments of a polishing head, a polishing apparatus, and an elastic body will be described below in detail with reference to the accompanying drawings. The present invention is not limited to the following embodiments. Constituent elements in the following embodiments include those that can be easily assumed by a person skilled in the art or those that are substantially the same.

First Embodiment

Hereinafter, a first embodiment will be described in detail with reference to FIGS. 1 to 6B.

Configuration Example of Polishing Apparatus

Figure 1:
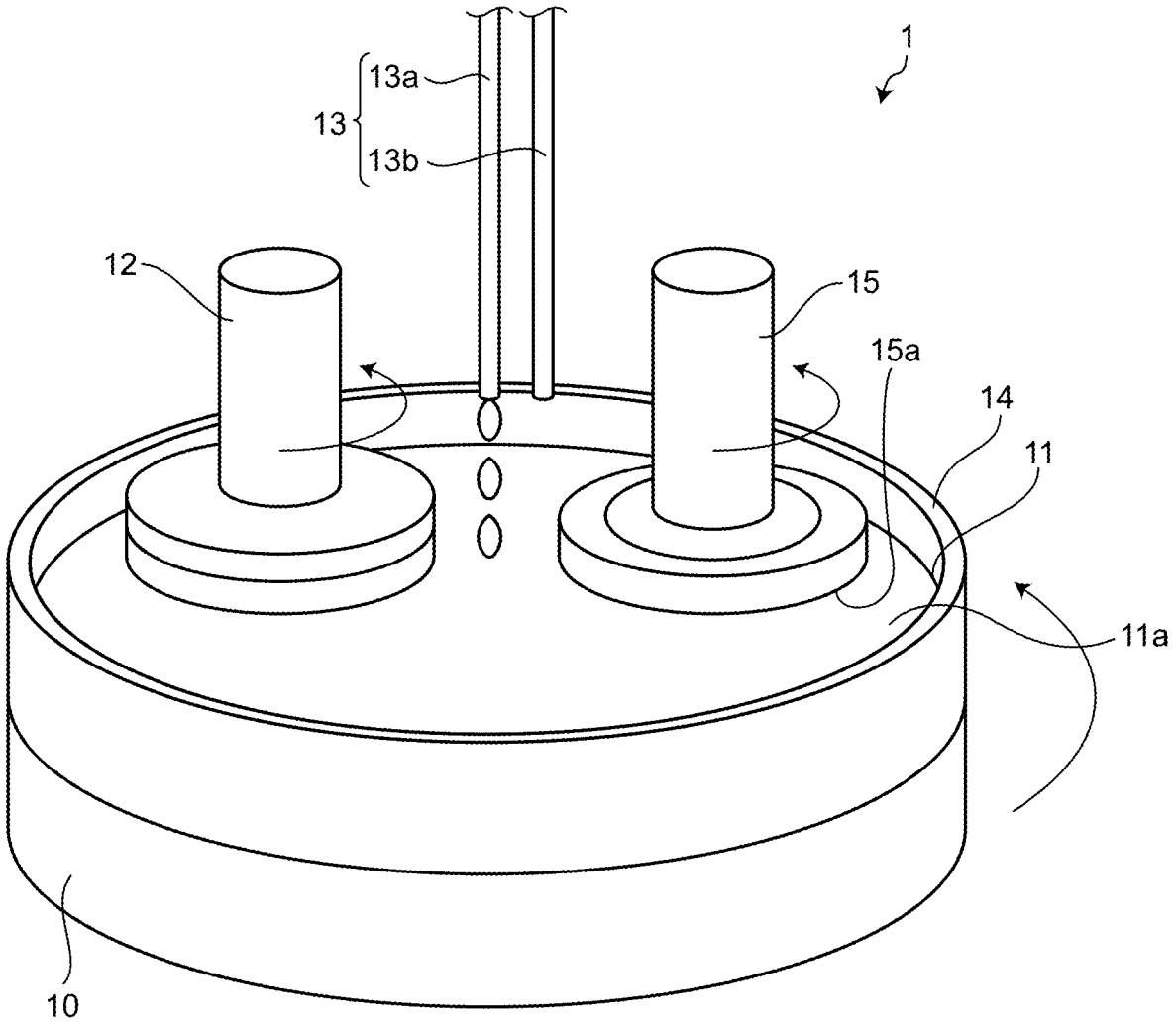
FIG. 1 is a diagram illustrating an example of a configuration of a polishing apparatus according to a first embodiment.

FIG. 1 is a diagram illustrating an example of a configuration of a polishing apparatus 1 according to a first embodiment.

In the present specification, a direction orthogonal to a polishing pad 11 is defined as a vertical direction. At this time, a direction in which a polishing surface 11*a* of the polishing pad 11 faces is defined as an upward direction, and the opposite direction is defined as a downward direction.

A substrate 100 (see FIG. 2) as a substrate to be processed by the polishing apparatus 1 according to the embodiment has a predetermined film such as an oxide film on a main surface 100*a* (see FIG. 2) as a surface to be polished. The polishing apparatus 1 is configured as a polishing apparatus that polishes the main surface 100*a* including the predetermined film.

As illustrated in FIG. 1, the polishing apparatus 1 includes a turntable 10, the polishing pad 11, a polishing head 12, a plurality of chemical solution supply nozzles 13, a peripheral wall 14, and a dresser 15.

The turntable 10 includes a platen (not illustrated). The turntable 10 is formed in a substantially disk shape and rotates around a central portion as an axis when the substrate 100 is polished. The polishing pad 11 is placed on the upper surface of the turntable 10.

The polishing pad 11 is made of a material such as polyurethane resin and is formed in a substantially disk shape. The polishing pad 11 is attached to the upper surface of the turntable 10 via an adhesive layer (not illustrated). The polishing pad 11 has the polishing surface 11*a* for polishing the main surface 100*a* of the substrate 100 on the upper surface thereof. Although not illustrated, a large number of protrusions having a minute height are uniformly formed in the polishing surface 11*a*. When polishing the substrate 100, the polishing pad 11 rotates together with the turntable 10.

The polishing head 12 is disposed above the turntable 10 so as to face the polishing surface 11*a*. The polishing head 12 holds the substrate 100 on a lower surface 23*b* of a membrane 23 described later. The polishing head 12 is configured to be movable in the vertical direction so that the held substrate 100 can come into contact with the polishing surface 11*a*. In addition, the polishing head 12 is configured such that the held substrate 100 is rotatable within the same plane as the polishing surface 11*a*.

The plurality of chemical solution supply nozzles 13 are provided above the turntable 10. The plurality of chemical solution supply nozzles 13 include a slurry supply nozzle 13*a* and a pure water supply nozzle 13*b*. The slurry supply nozzle 13*a* supplies slurry (hereinafter, it is also referred to as "polishing agent") to the polishing surface 11*a*. The slurry includes a physical component (for example, alumina, silica, or the like) and a chemical component. The pure water supply nozzle 13*b* supplies pure water or the like to the polishing surface 11*a*. Each of the slurry supply nozzle 13*a* and the pure water supply nozzle 13*b* is connected to a supply tank (not illustrated).

The peripheral wall 14 is provided so as to surround the side surface of the polishing pad 11. When the substrate 100 is polished, the peripheral wall 14 prevents an unnecessary outflow of the polishing agent or the like supplied to the polishing surface 11*a* and enables a predetermined amount of slurry or the like to be accumulated on the polishing surface 11*a*.

The dresser 15 is provided above the turntable 10. For example, diamond particles are adhered in a substantially annular shape to a grinding surface 15*a* of the dresser 15 facing the polishing surface 11*a*. The dresser 15 is configured to be movable in the vertical direction such that the grinding surface 15*a* can come into contact with the polishing surface 11*a*. In addition, the grinding surface 15*a* is configured to be rotatable in the same plane as the polishing surface 11*a*. The dresser 15 grinds and sets the polishing surface 11*a* on the grinding surface 15*a*.

Next, a detailed configuration example of the polishing head 12 included in the polishing apparatus 1 will be described with reference to FIGS. 2 to 4.

Figure 2:
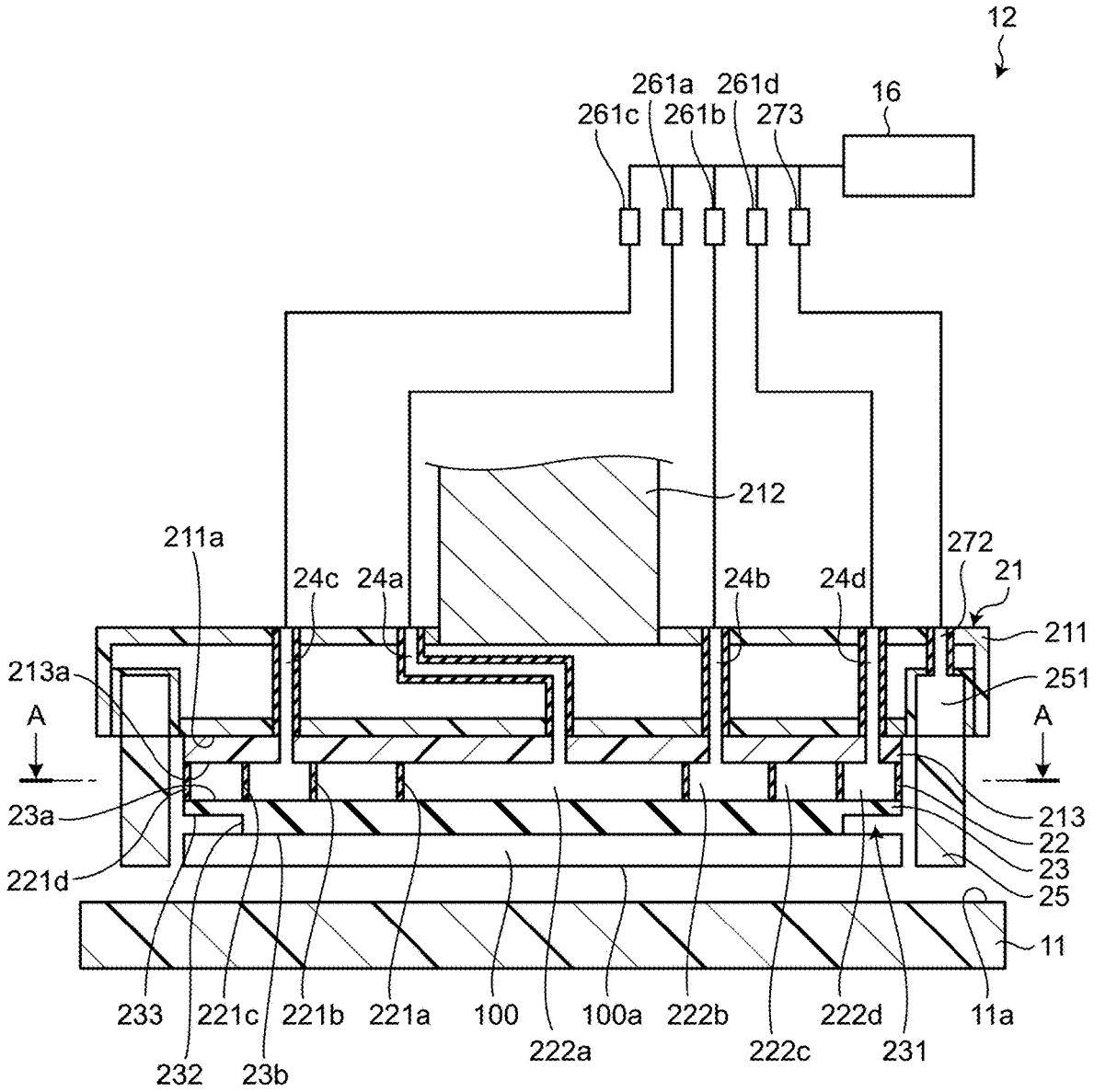
FIG. 2 is a sectional view illustrating an example of a state in which a substrate is held by a polishing head according to the first embodiment.

FIG. 2 is a sectional view illustrating an example of a state in which the substrate 100 is held by the polishing head 12 according to the first embodiment.

As illustrated in FIG. 2, the polishing head 12 includes a head body 21, an airbag 22, a membrane 23, a plurality of supply pipes 24*a* to 24*d* (24), and a retainer ring 25.

The head body 21 is formed in a substantially circular shape as viewed from the upward direction. The head body 21 includes a top cover 211, a shaft 212 connected to a central portion of the upper surface of the top cover 211, and a plate 213.

The top cover 211 is disposed to face the polishing surface 11*a*. The top cover 211 is driven by a motor (not illustrated) connected via the shaft 212 and is configured to be rotatable about the shaft 212 in a direction perpendicular to the vertical direction, that is, parallel to the polishing surface 11*a*. Although details will be described later, the membrane 23 capable of holding a substrate is provided below the top cover 211. That is, the top cover 211 is configured to be able to rotate the substrate 100 held by the membrane 23 parallel to the polishing surface 11*a*. In addition, a plate 213 is provided on the main surface 211*a* of the top cover 211 facing in the downward direction.

The plate 213 is made of, for example, polyether ether ketone (PEEK) resin, and is formed in a substantially disk shape. The plate 213 is disposed between the main surface 211*a* of the top cover 211 and the airbag 22. The plate 213 closes the upper surface of the airbag 22 on a main surface 213*a* of the plate 213 facing in the downward direction.

The airbag 22 is configured to be able to contain gas, expands with the pressure of the contained gas, and pushes down the membrane 23 disposed on the lower surface in a downward direction. A material of the airbag 22 is, for example, rubber.

Figure 3:
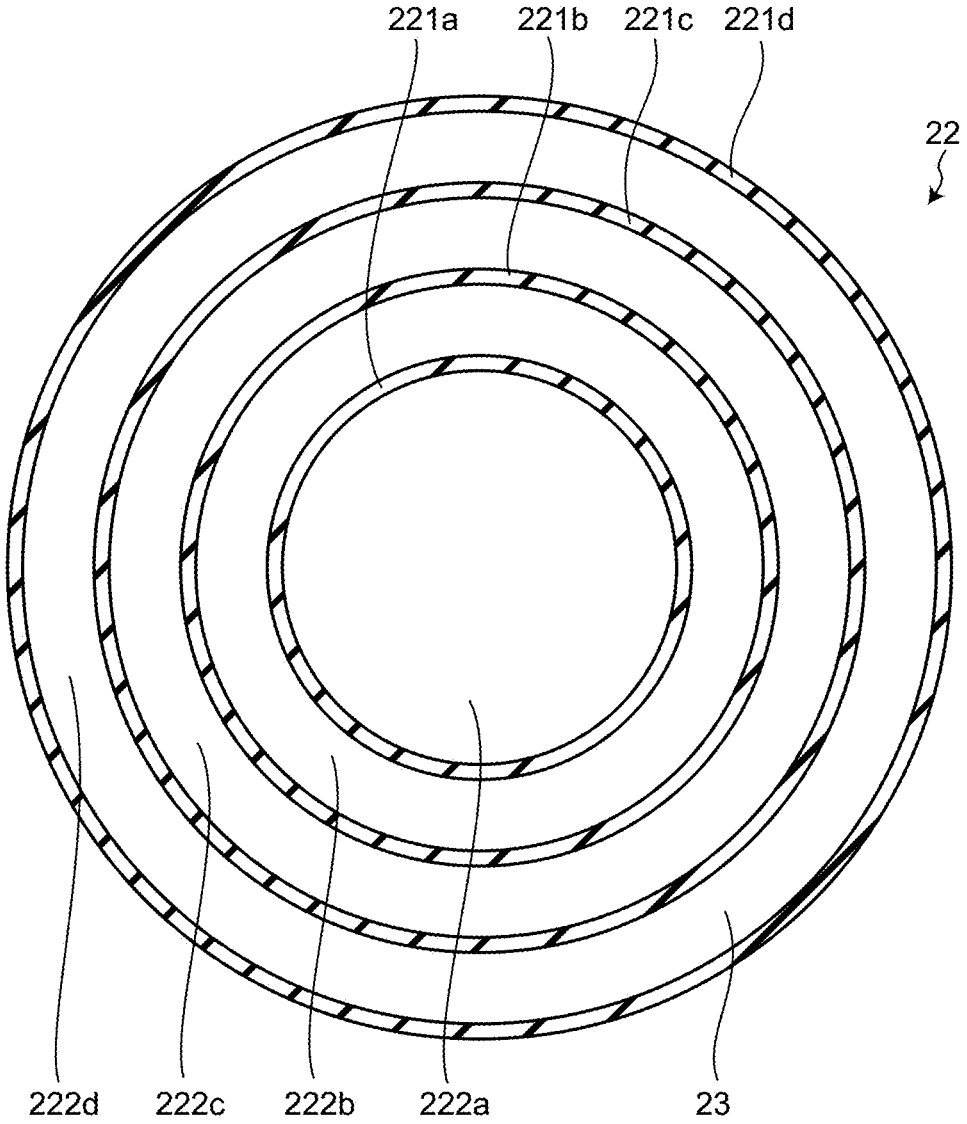
FIG. 3 is a sectional view illustrating an example of a section of an airbag according to the first embodiment.

FIG. 3 is a sectional view of the airbag 22 according to the first embodiment taken along the line A-A in FIG. 2. As illustrated in FIG. 3, the airbag 22 is formed in a substantially circular shape as viewed from the upward direction. The airbag 22 is disposed between the plate 213 and the membrane 23. The upper surface of the airbag 22 is closed by the main surface 213*a* of the plate 213, and the lower surface of the airbag 22 is closed by an upper surface 23*a* of the membrane 23.

More specifically, the airbag 22 is partitioned into four compartments 222*a* to 222*d* by four partition walls 221*a* to 221*d* disposed concentrically and extending from the main surface 213*a* of the plate 213 toward the upper surface 23*a* of the membrane 23.

As illustrated in FIG. 3, each of the four compartments 222*a* to 222*d* has a configuration in which the compartment 222*b*, the compartment 222*c*, and the compartment 222*d* each having a substantially annular shape are concentrically disposed outward around the compartment 222*a* having a substantially circular shape. Each of the compartments 222*a* to 222*d* individually contains gas such as compressed air and is configured to be expandable by the pressure of the contained gas. That is, each of the compartments 222*a* to 222*d* is displaced in the vertical direction by the pressure of the contained gas, and for example, the membrane 23 overlapping in the vertical direction is pushed in the downward direction.

As illustrated in FIG. 2, each of the supply pipes 24*a* to 24*d* extends in the upward direction from each of the compartments 222*a* to 222*d* and penetrates the plate 213 and the top cover 211 in the vertical direction. The supply pipes 24*a* to 24*d* are connected to a supply unit 16 capable of supplying compressed gas such as compressed air. The supply pipes 24*a* to 24*d* are individually provided with pressure regulators 261*a* to 261*d* between the supply unit 16 and the compartments 222*a* to 222*d*.

For example, the compressed air or the like supplied from the supply unit 16 passes through the pressure regulators 261*a* to 261*d* and is independently supplied to each of the compartments 222*a* to 222*d*. That is, the pressures of the compressed air or the like in the compartments 222*a* to 222*d* can be individually changed by adjusting the pressure regulators 261*a* to 261*d*. This configuration allows the amounts of displacement of the compartments 222*a* to 222*d* in the vertical direction to be controlled independently.

The supply pipes 24*a* to 24*d* are connected to a vacuum pump (not illustrated) and can form a vacuum in the compartments 222*a* to 222*d*. For example, although not illustrated, an opening penetrating in the vertical direction is formed in the membrane 23 vertically overlapping the compartment 222*c*. Forming a vacuum in the compartment 222*c* causes the substrate 100 to be sucked on the lower surface 23*b* of the membrane 23, and supplying air or the like to the compartment 222*c* causes the substrate 100 to be released from the lower surface 23*b* of the membrane 23.

Each of the compartments 222*a* to 222*d*, the plurality of supply pipes 24*a* to 24*d*, and the supply unit 16 is an example of the substrate pressing part.

The membrane 23 holds the substrate 100. That is, the membrane 23 is pressed down in the downward direction by the expansion of the airbag 22 to press the held substrate 100 against the polishing surface 11*a*. The material of the membrane 23 is, for example, silicone rubber, butyl rubber, chloroprene rubber, or the like. The membrane 23 is an example of an elastic body.

Figure 4:
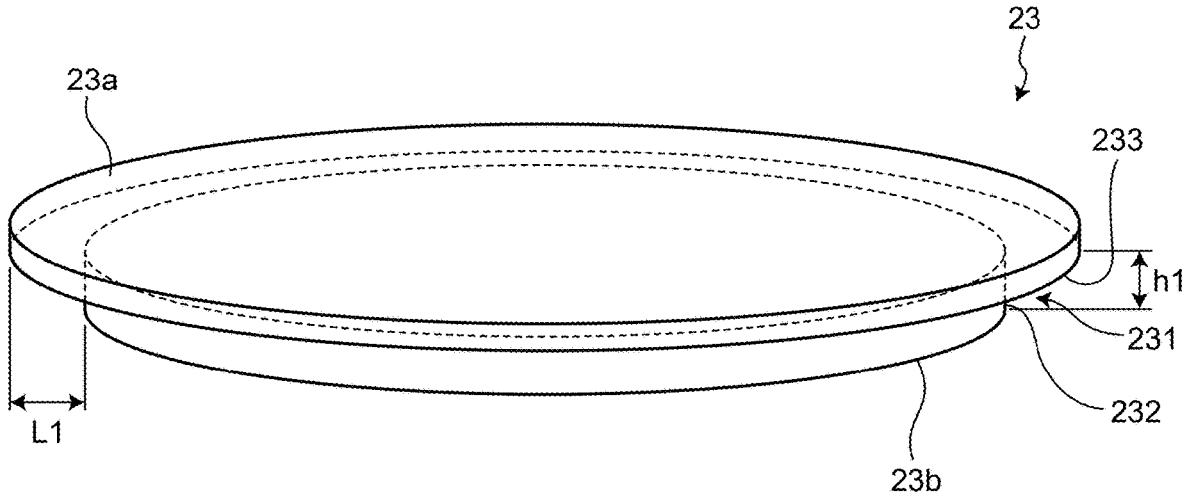
FIG. 4 is a schematic diagram illustrating an example of a configuration of a membrane according to the first embodiment.

FIG. 4 is a schematic diagram illustrating an example of a configuration of the membrane 23 according to the first embodiment. As illustrated in FIG. 4, the membrane 23 is formed in a substantially disk shape and includes the upper surface 23*a*, the lower surface 23*b*, and a step portion 231 recessed in the upward direction from the lower surface 23*b*.

The upper surface 23*a* of the membrane 23 covers the lower surfaces of the compartments 222*a* to 222*d*. The lower surface 23*b* of the membrane 23 is configured to be able to hold the substrate 100. In other words, when the substrate 100 is polished, the membrane 23 is disposed between the lower surfaces of the compartments 222*a* to 222*d* and the main surface 100*a* of the substrate 100. The lower surface 23*b* is an example of a substrate holding surface.

The step portion 231 has a side surface 232 bending and extending in the upward direction from the lower surface 23*b* of the membrane 23, and a bottom surface 233 bending from an upper end of the side surface 232 and extending toward the outside of the membrane 23.

The side surface 232 is formed in a range overlapping in the vertical direction with the compartment 222*d* disposed at the outermost periphery among the four compartments 222*a* to 222*d* and defines the outermost periphery of the lower surface 23*b* at a lower end. In other words, the lower surface 23*b* of the membrane 23 is formed so as to be within a range overlapping the compartment 222*d* in the vertical direction.

The bottom surface 233 extends outward in a radial direction from an upper end of the side surface 232 and faces in the downward direction. That is, when the substrate 100 is polished, the bottom surface 233 faces the substrate 100 in a range overlapping the compartment 222*d* in the vertical direction.

The membrane 23 is pushed down in the downward direction by a pressure proportional to the displacement amount of each of the compartments 222*a* to 222*d*. That is, as the displacement amount of each of the compartments 222*a* to 222*d* becomes larger, the membrane 23 in a range overlapping each of the compartments 222*a* to 222*d* in the vertical direction is pushed down in the downward direction by a large pressure.

In the example of FIG. 4, the thickness of the side surface 232 in the vertical direction is indicated by h1. The width of the bottom surface 233 in the radial direction is indicated by L1.

The retainer ring 25 is made of resin or the like and is formed in a substantially annular shape as viewed from the upward direction. The retainer ring 25 is disposed around the polishing head 12 and has a retainer ring pressing unit 251 in the upward direction.

The retainer ring pressing unit 251 is disposed in an annular shape inside the top cover 211 and is connected to the upper end of the retainer ring 25. The retainer ring pressing unit 251 includes a supply pipe 272 that extends in the upward direction from the retainer ring pressing unit 251, penetrates the top cover 211 in the vertical direction, and is connected to the supply unit 16. A pressure regulator 273 is provided between the supply unit 16 and the retainer ring pressing unit 251 of the supply pipe 272.

The compressed air or the like supplied from the supply unit 16 are supplied to the retainer ring pressing unit 251 through the pressure regulator 273. The retainer ring pressing unit 251 applies a pressure in the downward direction to the upper surface of the retainer ring 25. Then, the lower surface of the retainer ring 25 is pressed against the polishing surface 11*a*. This makes it possible to prevent the substrate 100 from flying out of the polishing head 12 when the substrate 100 is polished.

Figure 5:
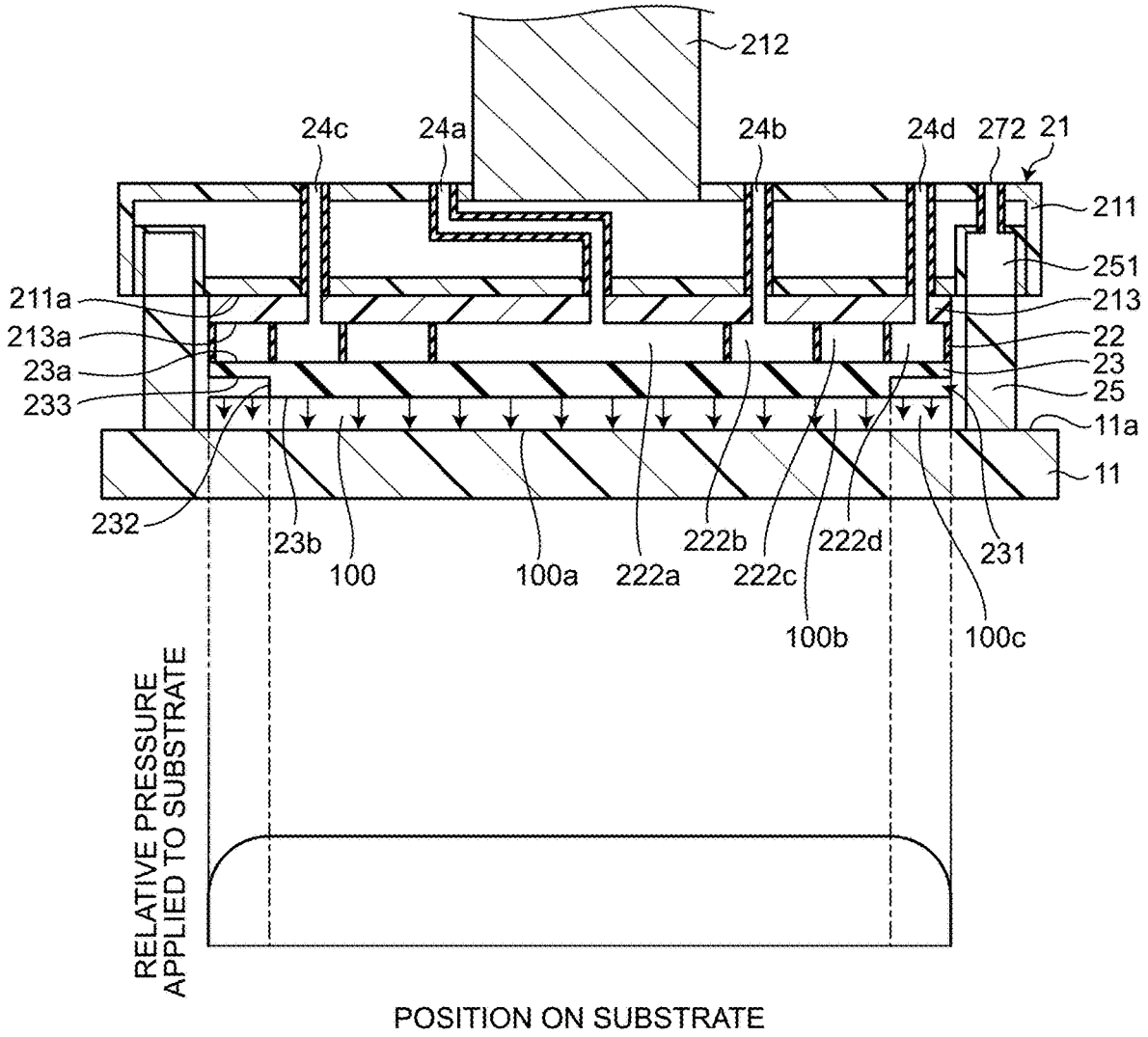
FIG. 5 is a diagram illustrating an example of a state in which a substrate is held by the polishing apparatus according to the first embodiment.

Next, a method of polishing the substrate 100 using the polishing apparatus 1 will be described with reference to FIG. 5. FIG. 5 is a diagram illustrating an example of a state in which the substrate 100 is held by the polishing apparatus 1 according to the first embodiment.

When the main surface 100*a* of the substrate 100 is polished, first, the substrate 100 is sucked to the membrane 23 with the main surface 100*a* facing in the downward direction. Next, a polishing agent or the like is supplied to the polishing surface 11*a* while the top cover 211 of the head body 21 and the turntable 10 are rotated. Next, the polishing head 12 is moved to bring the main surface 100*a* closer to the polishing surface 11*a*.

When compressed air or the like is supplied from the supply unit 16 to the compartments 222*a* to 222*d* via the supply pipes 24*a* to 26*d*, each of the compartments 222*a* to 222*d* expands according to the pressure of the contained compressed air or the like and is displaced in the downward direction. The membrane 23 that closes the lower surfaces of the compartments 222*a* to 222*d* is pushed down in the downward direction as the compartments 222*a* to 222*d* are displaced. This causes the substrate 100 to be pressed against the polishing surface 11*a*, and the main surface 100*a* is polished.

Here, the pressure applied to the substrate 100 when the substrate 100 is pressed against the polishing surface 11*a* will be described with reference to FIGS. 5, 6A, and 6B.

As illustrated in FIG. 5, when the substrate 100 is held by the membrane 23, the substrate 100 substantially abuts on the lower surface 23*b* of the membrane 23 at an inner portion 100*b*. The inner portion 100*b* is a portion of the substrate 100 that overlaps the lower surface 23*b* of the membrane 23 in the vertical direction. Thus, when the lower surface 23*b* is pushed down along with the displacement of each of the compartments 222*a* to 222*d*, the inner portion 100*b* substantially in contact with the lower surface 23*b* is pressed against the polishing surface 11*a* with a predetermined pressure.

On the other hand, when the substrate 100 is held by the membrane 23, the substrate 100 faces the bottom surface 233 of the membrane 23 at an outer portion 100*c*. The bottom surface 233 of the membrane 23 is formed in a range overlapping the outermost peripheral compartment 222*d* among the compartments 222*a* to 222*d* in the vertical direction. That is, the outer portion 100*c* is a portion of the substrate 100 where the substrate 100 faces the partition wall 221*d* with the bottom surface 233 interposed therebetween.

The outer portion 100*c* of the substrate 100 is separated from the bottom surface 233 in the vertical direction. Thus, even when the bottom surface 233 is pushed down along with the displacement of the compartment 222*d*, the outer portion 100*c* and the bottom surface 233 do not abut on each other, or only an end of the bottom surface 233 substantially abuts on the outer portion 100*c* due to deflection of the bottom surface 233 in the downward direction. As a result, since the outer portion 100*c* of the substrate 100 is hardly pressed against the polishing surface 11*a*, a pressure relatively smaller than the pressure applied to the inner portion 100*b* is applied to the outer portion 100*c*.

The above-described configuration can reduce the pressure applied to the outer portion 100*c* of the substrate 100 with respect to the pressure applied to the inner portion 100*b* when the substrate 100 is pressed against the polishing surface 11*a*.

The magnitude and range of the pressure applied to the outer portion 100*c* can be adjusted by changing the shape of the step portion 231. FIGS. 6A and 6B are schematic diagrams illustrating an example of a configuration of the membrane 23 according to the first embodiment.

Figure 6A:
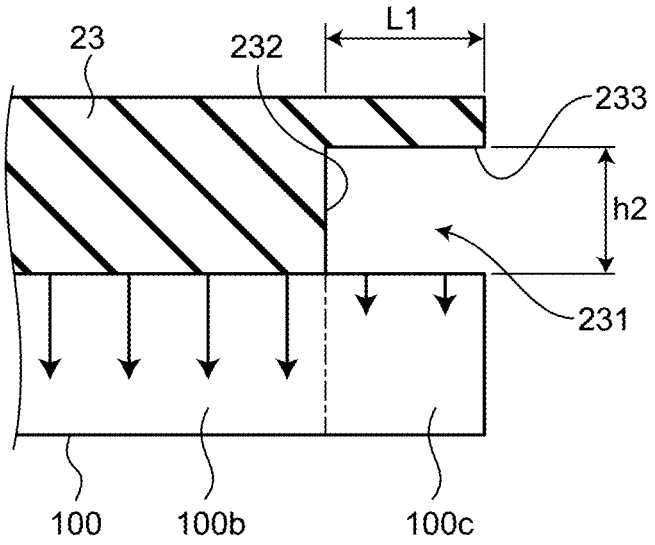
FIGS. 6A and 6B are schematic diagrams illustrating an example of a configuration of the membrane according to the first embodiment.

For example, as illustrated in FIG. 6A, a case is considered in which the membrane 23 having a thickness h2 as the thickness of the side surface 232 in the vertical direction, the thickness h2 being larger than the thickness h1 illustrated in FIG. 4, is used. That is, the bottom surface 233 of the membrane 23 is further separated from the substrate 100. In such a case, even when the membrane 23 is pushed down in the downward direction, the outer portion 100*c* of the substrate 100 is hardly pressed against the polishing surface 11*a* any longer. As a result, the pressure applied to the outer portion 100*c* of the substrate 100 is further reduced.

On the other hand, although not illustrated, a case in considered in which the membrane 23 having a thickness as the thickness of the side surface 232 in the vertical direction, the thickness being smaller than the thickness h1 illustrated in FIG. 4, is used. That is, the bottom surface 233 of the membrane 23 is brought closer to the substrate 100. In such a case, when the membrane 23 is pushed down in the downward direction, the outer portion 100*c* of the substrate 100 may be easily pressed against the polishing surface 11*a* by the membrane 23. This can increase the pressure applied to the outer portion 100*c* of the substrate 100.

Figure 6B:
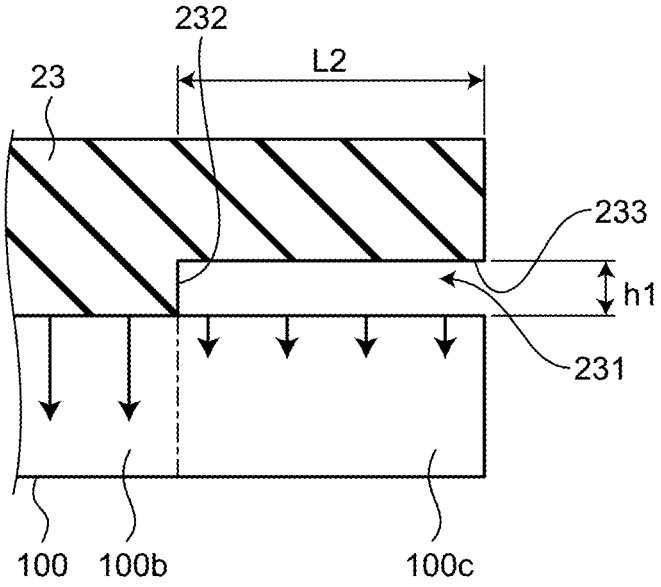

For example, as illustrated in FIG. 6B, a case in considered in which the membrane 23 having a width L2 as a width of the bottom surface 233 in the radial direction, the width L2 being larger than the width L1 illustrated in FIG. 4, is used. That is, as a result, the outer portion 100*c* of the substrate 100 expands in the radial direction. In other words, the region pressed against the polishing surface 11*a* with a pressure lower than that of the inner portion 100*b* of the substrate 100 can be expanded in the radial direction.

On the other hand, although not illustrated, a case is considered in which the membrane 23 having a width as the bottom surface 233 in the radial direction, the width being smaller than the width L1 illustrated in FIG. 4, is used. That is, the outer portion 100*c* is thereby narrowed in the radial direction. In other words, the region pressed against the polishing surface 11*a* with a pressure lower than that of the inner portion 100*b* of the substrate 100 can be narrowed in the radial direction.

In this manner, using the membrane 23 in which the shape of the step portion 231 is changed in the range overlapping the compartment 222*a* in the vertical direction can freely adjust the pressure applied to the outer portion 100*c* of the substrate 100.

Comparative Example

Figure 9:
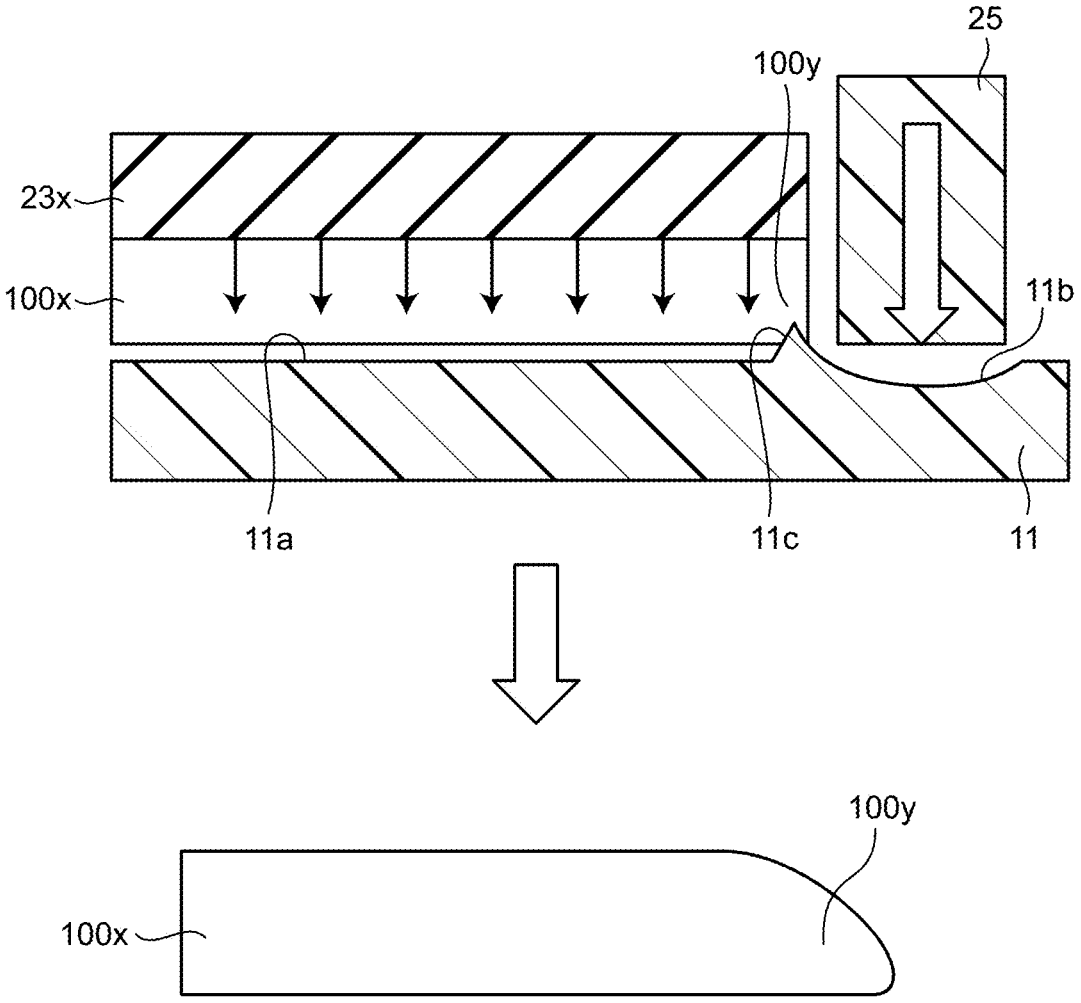
FIG. 9 is a schematic diagram for explaining a shape of a substrate polished by a polishing apparatus of a comparative example.

Next, a polishing apparatus of a comparative example will be described with reference to FIGS. 9 to 11. A membrane 23*x* of the polishing apparatus of the comparative example has no step at an end. FIG. 9 is a schematic diagram for explaining a shape of a substrate 100*x* polished by the polishing apparatus of the comparative example.

As illustrated in FIG. 9, when the substrate 100*x* is polished, the retainer ring 25 is pressed against the polishing surface 11*a*. Then, a region 11*b* of the polishing surface 11*a* pressed by the retainer ring 25 may be recessed in the downward direction by the pressure applied from the retainer ring 25. Because of this recess, a protrusion 11*c* protruding in the upward direction from the polishing surface 11*x* may be formed at an edge of the region 11*b*.

When the membrane 23*x* is pushed down by the displacement of the compartments 222*a* to 222*d*, the substrate 100*x* is pressed against the polishing surface 11*x* by the entire lower surface of the membrane 23*x*. At this time, an end 100*y* of the substrate 100*x* may be excessively polished. This is because the end 100*y* and the protrusion 11*c* may overlap in the vertical direction.

In such a case, for example, the pressure at which the membrane 23*x* is pushed down may be reduced by adjusting the displacement amounts of the compartments 222*a* to 222*d*. However, the pressure applied to the membrane 23*x* is adjusted based on the pressure of the compressed air or the like contained in each of the compartments 222*a* to 222*d*, the width of each of the compartments 222*a* to 222*d* in the radial direction, and the like. Thus, it may be difficult to locally reduce only the pressure applied to the end 100*y* in a range overlapping the compartment 222*d* in the vertical direction.

Figure 10:
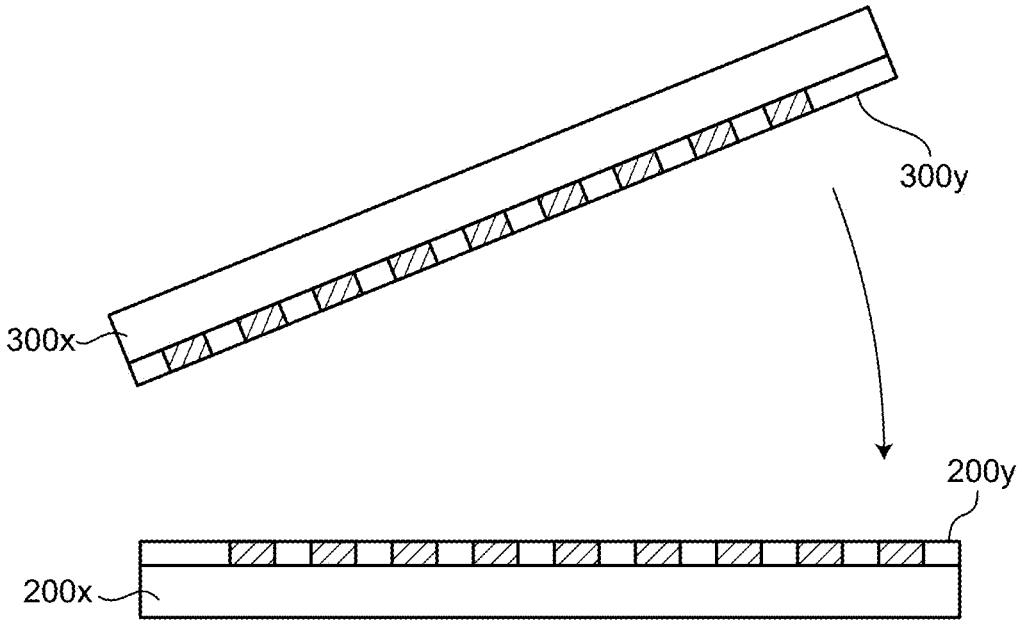
FIG. 10 is a schematic diagram for explaining a semiconductor device to which a polishing apparatus of a comparative example is applied.
Figure 11:
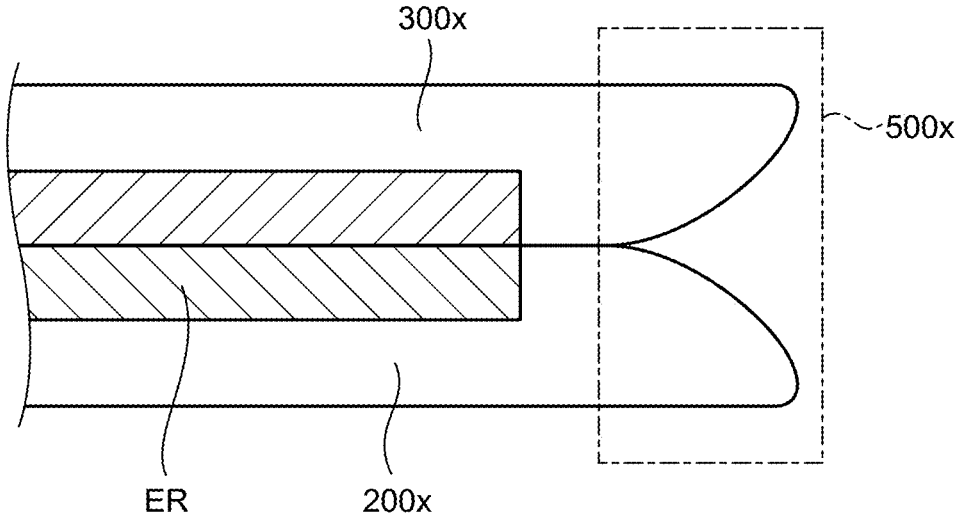
FIG. 11 is a schematic diagram for explaining a semiconductor device to which the polishing apparatus of the comparative example is applied.

FIGS. 10 and 11 are schematic diagrams for explaining a semiconductor device to which a polishing apparatus of the comparative example is applied.

As illustrated in FIG. 10, a semiconductor device may be formed by bonding a substrate 200*x* and a substrate 300*x*. For example, a stacked body in which a conductive layer and an insulating layer are repeatedly stacked is disposed on a main surface 200*y* of the substrate 200*x*, and a semiconductor film extends in the stacked body perpendicularly to the stacking direction, whereby a three-dimensional memory cell array is formed. On the other hand, for example, a semiconductor layer, a conductive layer, an insulating layer, and the like are stacked on a main surface 300*y* of the substrate 300*x* to form a CMOS structure, whereby a control circuit for controlling the memory cell array is formed.

To form the above-described configuration, each of the substrate 200*x* and the substrate 300*x* is polished in a plurality of manufacturing steps. Thus, as described with reference to FIG. 9, an end of the main surface 200*y* of the substrate 200*x* and an end of the main surface 300*y* of the substrate 300*x* are excessively polished, and the flatness is not secured in some cases.

As illustrated in FIG. 11, when the main surface 200*y* and the main surface 300*y* like these are bonded to each other, as a result of overlapping the excessively polished ends with each other, a non-bonding region 500*x* in which the main surfaces are not bonded to each other may be formed at the ends of the bonded substrates of the substrate 200*x* and the substrate 300*x*. When the non-bonding region 500*x* like this is widely formed in the outer peripheral portion of the bonded substrates, the likelihood for securing an effective chip region ER may decrease. As a result, the yield of the semiconductor device may decrease.

The polishing head 12 of the first embodiment includes the head body 21 disposed to face the polishing pad 11 for polishing the main surface 100*a* of the substrate 100, the head body 21 being capable of rotating the substrate 100 with respect to the polishing pad 11. The polishing head 12 also includes compartments 222*a* to 222*d* concentrically provided on the main surface 213*a* facing in the downward direction of the plate 213, the compartments 222*a* to 222*d* being independently displaceable with respect to the polishing pad 11 by changing the pressure of the contained compressed air or the like. The polishing head 12 also includes the membrane 23 provided between the lower surfaces of the compartments 222*a* to 222*d* and the main surface 100*a* of the substrate 100, the membrane 23 being capable of holding the substrate 100 on the lower surface 23*b*. With this configuration, when the compartments 222*a* to 222*d* are displaced and the membrane 23 is pushed downward, the substrate 100 is pressed against the polishing pad 11 by the lower surface 23*b* of the membrane 23. This causes the main surface 100*a* to be polished.

The lower surface 23*b* of the membrane 23 is formed so as to fit inside a range facing the compartment 222*d*. More specifically, the membrane 23 has the step portion 231 recessed from the lower surface 23*b* toward the compartment 222*d* in a range facing the compartment 222*d*. This configuration can reduce the pressure applied to the end of the substrate 100 in a range overlapping the compartment 222*d* in the vertical direction. As a result, since the end of the substrate 100 is prevented from being excessively polished, the flatness of the substrate 100 can improve.

Second Embodiment

Hereinafter, a second embodiment will be described in detail with reference to FIGS. 7 and 8. A polishing apparatus of the second embodiment includes a membrane 52 having a shape different from the shape of the membrane of the first embodiment described above.

In the following description, the same reference numerals are given to the same configurations as those of the first embodiment described above, and the description thereof may be omitted.

Configuration Example of Polishing Apparatus

Figure 7:
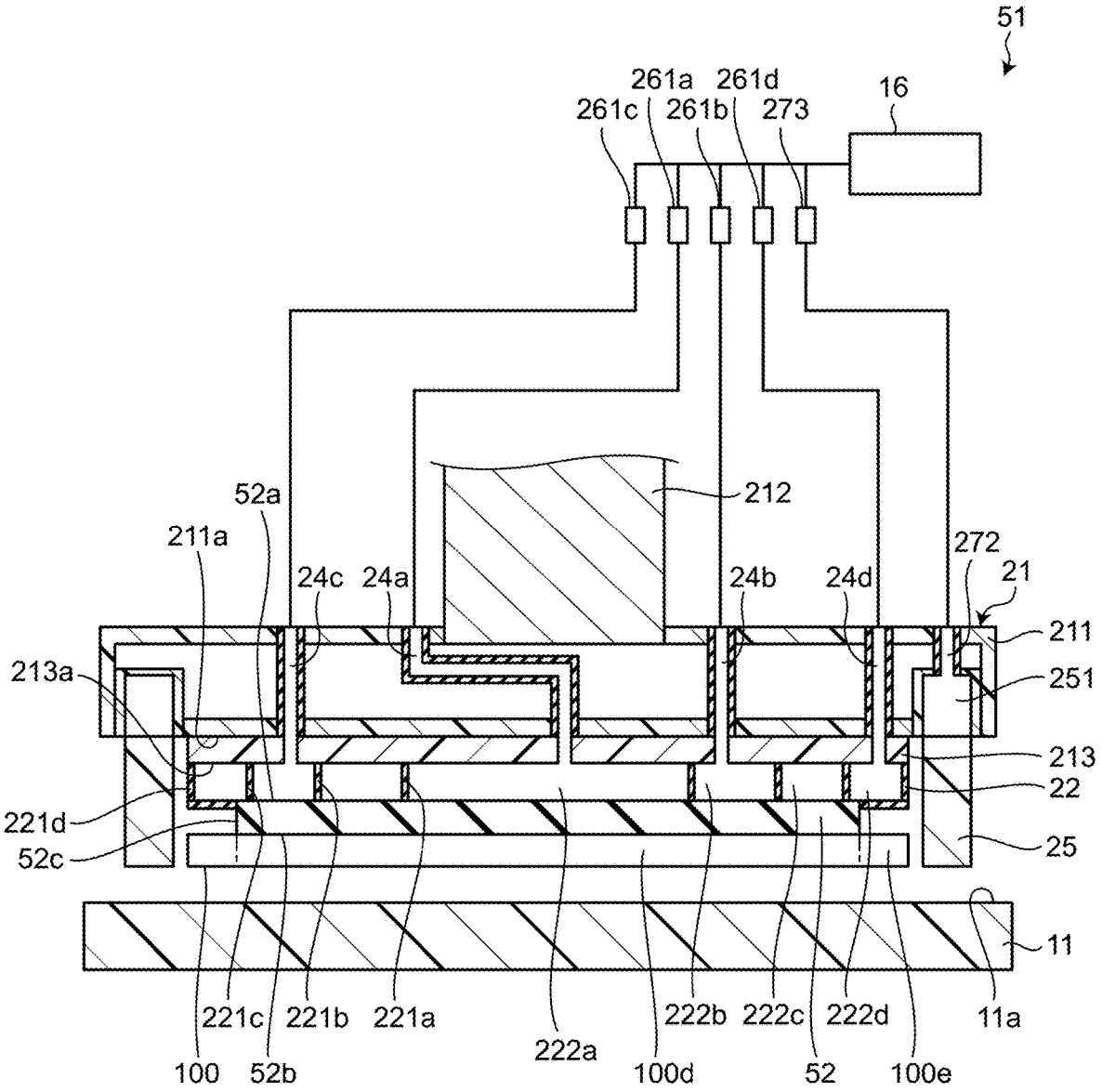
FIG. 7 is a sectional view illustrating an example of a state in which a substrate is held by a polishing head according to a second embodiment.

FIG. 7 is a sectional view illustrating an example of a state in which the substrate 100 is held by a polishing head 51 according to the second embodiment. FIG. 8 is a schematic diagram illustrating an example of a configuration of the membrane 52 according to the second embodiment.

As illustrated in FIG. 7, the polishing head 51 includes the head body 21, the airbag 22, the membrane 52, the plurality of supply pipes 24*a* to 24*d* (24), and the retainer ring 25.

Figure 8:
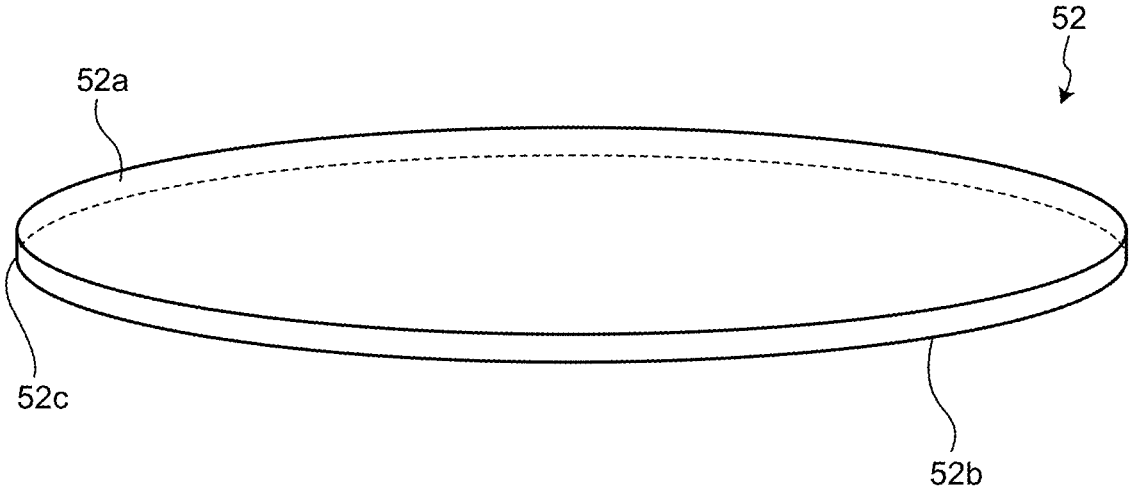
FIG. 8 is a schematic diagram illustrating an example of a configuration of a membrane according to the second embodiment.

As illustrated in FIG. 8, the membrane 52 is formed in a substantially disk shape. The membrane 52 includes an upper surface 52*a*, a lower surface 52*b*, and an outer peripheral edge 52*c* that defines the outer periphery of the membrane 52. That is, the membrane 52 does not have the step portion 231 unlike the membrane 23 of the first embodiment.

The upper surface 52*a* of the membrane 52 covers the lower surfaces of the compartments 222*a* to 222*d*. The lower surface 52*b* of the membrane 52 faces the substrate 100 and is configured to be able to suck the substrate 100. In other words, when the substrate 100 is polished, the membrane 52 is disposed between the lower surfaces of the compartments 222*a* to 222*d* and the main surface 100*a* of the substrate 100.

The membrane 52 is provided such that an outer peripheral edge 52*c* thereof is positioned in a range overlapping the compartment 222*d* in the vertical direction. In other words, the outer peripheral edge 52*c* of the membrane 52 is positioned inside the outermost peripheral partition wall 221*d* of the compartment 222*d*. The membrane 52 is an example of an elastic body.

As illustrated in FIG. 7, when the substrate 100 is held by the membrane 52, the substrate 100 substantially abuts on the lower surface 52*b* of the membrane 52 at an inner portion 100*d*. The inner portion 100*d* is a portion of the substrate 100 that overlaps the lower surface 52*b* of the membrane 52 in the vertical direction. Thus, when the lower surface 52*b* is pushed down along with the displacement of each of the compartments 222*a* to 222*d*, the inner portion 100*d* substantially in contact with the lower surface 52*b* is pressed against the polishing surface 11*a* with a predetermined pressure.

On the other hand, the membrane 52 is not provided in the upward direction of an outer portion 100*e* of the substrate 100. This is because the membrane 52 is positioned inside the position overlapping the outermost peripheral partition wall 221*d* of the compartment 222*d*. That is, the outer portion 100*e* is a portion of the substrate 100 where the substrate 100 faces the partition wall 221*d* without interposing the membrane 52 therebetween. As a result, even when the membrane 52 is pushed down in the downward direction along with the displacement of the compartments 222*a* to 222*d*, the outer portion 100*e* does not abut on the membrane 52, and thus, the outer portion 100*e* is less likely to be pressed against the polishing surface 11*a* than the inner portion 100*d*.

The above-described configuration can reduce the pressure applied to the outer portion 100*e* of the substrate 100 with respect to the pressure applied to the inner portion 100*d* when the substrate 100 is pressed against the polishing surface 11*a*.

As described above, the membrane 52 of the second embodiment includes the upper surface 52*a*, the lower surface 52*b*, and the outer peripheral edge 52*c*, and the outer peripheral edge 52*c* is positioned inside the outer peripheral edge of the compartment 222*d*. In this manner, since the membrane 52 does not have a complicated configuration, it can be easily processed by an existing processing apparatus.

According to the membrane 52, the polishing head 51, and the polishing apparatus of the second embodiment as described above, the same effects as those of the membrane 23, the polishing head 12, and the polishing apparatus 1 of the first embodiment described above are obtained.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A polishing head comprising:

a head body disposed to face a polishing pad for polishing a surface to be polished of a substrate to be processed, the head body being capable of rotating the substrate to be processed with respect to the polishing pad;

a plurality of substrate pressing parts provided concentrically on a surface of the head body on a polishing pad side, the substrate pressing parts being independently displaceable with respect to the polishing pad with a pressure change of contained gas; and an elastic body provided between the surface to be polished and surfaces of the plurality of substrate pressing parts on the polishing pad side, the elastic body being capable of holding the substrate to be processed on a substrate holding surface facing the polishing pad, wherein the elastic body includes a step portion recessed from the substrate holding surface toward an outermost peripheral substrate pressing part among the plurality of substrate pressing parts in a range facing the outermost peripheral substrate pressing part, and the substrate holding surface of the elastic body fits inside the range facing the outermost peripheral substrate pressing part.

2. The polishing head according to claim 1, wherein the step portion includes a side surface bending and extending in an upward direction from the substrate holding surface, and a bottom surface bending from an upper end of the side surface and extending toward an outside of the elastic body, and the bottom surface faces the substrate to be processed in a range overlapping the outermost peripheral substrate pressing part in a vertical direction.

3. The polishing head according to claim 1, wherein a material of the elastic body is at least one of silicone rubber, butyl rubber, and chloroprene rubber.

4. A polishing head comprising:

a head body disposed to face a polishing pad for polishing a surface to be polished of a substrate to be processed, the head body being capable of rotating the substrate to be processed with respect to the polishing pad;

a plurality of substrate pressing parts provided concentrically on a surface of the head body on a polishing pad side, the substrate pressing parts being independently displaceable with respect to the polishing pad with a pressure change of contained gas; and an elastic body provided between the surface to be polished and surfaces of the plurality of substrate pressing parts on the polishing pad side, the elastic body being capable of holding the substrate to be processed on a substrate holding surface facing the polishing pad, wherein an outer peripheral edge of the elastic body is positioned inside an outer peripheral edge of an outermost peripheral substrate pressing part among the plurality of substrate pressing parts, the substrate holding surface of the elastic body fits inside a range facing the outermost peripheral substrate pressing part, and the outermost peripheral substrate pressing part faces the substrate to be processed without interposing the elastic body between the outermost peripheral substrate pressing part and the substrate to be processed.

5. The polishing head according to claim 4, wherein a material of the elastic body is at least one of silicone rubber, butyl rubber, and chloroprene rubber.

6. A polishing apparatus comprising:

a polishing pad against which a surface to be polished of a substrate to be processed is pressed to polish the surface to be polished;

a plurality of substrate pressing parts provided concentrically on a surface of a head body on a polishing pad side, the substrate pressing parts being independently displaceable with respect to the polishing pad with a pressure change of contained gas; and an elastic body provided between the surface to be polished and surfaces of the plurality of substrate pressing parts on the polishing pad side, the elastic body being capable of holding the substrate to be processed on a substrate holding surface, wherein the elastic body includes a step portion recessed from the substrate holding surface toward an outermost peripheral substrate pressing part among the plurality of substrate pressing parts in a range facing the outermost peripheral substrate pressing part, and the substrate holding surface of the elastic body fits inside the range facing the outermost peripheral substrate pressing part.

7. The polishing apparatus according to claim 6, wherein the step portion includes a side surface bending and extending in an upward direction from the substrate holding surface, and a bottom surface bending from an upper end of the side surface and extending toward an outside of the elastic body, and the bottom surface faces the substrate to be processed in a range overlapping the outermost peripheral substrate pressing part in a vertical direction.

8. The polishing apparatus according to claim 6, wherein a material of the elastic body is at least one of silicone rubber, butyl rubber, and chloroprene rubber.

9. A polishing apparatus comprising:

a polishing pad against which a surface to be polished of a substrate to be processed is pressed to polish the surface to be polished;

a plurality of substrate pressing parts provided concentrically on a surface of a head body on a polishing pad side, the substrate pressing parts being independently displaceable with respect to the polishing pad with a pressure change of contained gas; and an elastic body provided between the surface to be polished and surfaces of the plurality of substrate pressing parts on the polishing pad side, the elastic body being capable of holding the substrate to be processed on a substrate holding surface, wherein an outer peripheral edge of the elastic body is positioned inside an outer peripheral edge of an outermost peripheral substrate pressing part among the plurality of substrate pressing parts, the substrate holding surface of the elastic body fits inside a range facing the outermost peripheral substrate pressing part, and the outermost peripheral substrate pressing part faces the substrate to be processed without interposing the elastic body between the outermost peripheral substrate pressing part and the substrate to be processed.

10. The polishing apparatus according to claim 9, wherein a material of the elastic body is at least one of silicone rubber, butyl rubber, and chloroprene rubber.

11. An elastic body used in a polishing head that presses a surface to be polished of a substrate to be processed against a polishing pad to polish the surface to be polished, the elastic body being provided between the surface to be polished and surfaces of a plurality of substrate pressing parts on a polishing pad side, the plurality of substrate pressing parts being concentrically provided on a surface of the polishing head on the polishing pad side and independently displaceable with respect to the polishing pad with a pressure change of contained gas, the elastic body being configured to be capable of holding the substrate to be processed on a substrate holding surface, wherein the elastic body includes a step portion recessed from the substrate holding surface toward an outermost peripheral substrate pressing part among the plurality of substrate pressing parts in a range facing the outermost peripheral substrate pressing part, and the substrate holding surface fits inside the range facing the outermost peripheral substrate pressing part.

12. The elastic body according to claim 11, wherein the step portion includes a side surface bending and extending in an upward direction from the substrate holding surface, and a bottom surface bending from an upper end of the side surface and extending toward an outside of the elastic body, and the bottom surface faces the substrate to be processed in a range overlapping the outermost peripheral substrate pressing part in a vertical direction.

13. The elastic body according to claim 11, wherein a material of the elastic body is at least one of silicone rubber, butyl rubber, and chloroprene rubber.

14. An elastic body used in a polishing head that presses a surface to be polished of a substrate to be processed against a polishing pad to polish the surface to be polished, the elastic body being provided between the surface to be polished and surfaces of a plurality of substrate pressing parts on a polishing pad side, the plurality of substrate pressing parts being concentrically provided on a surface of the polishing head on the polishing pad side and independently displaceable with respect to the polishing pad with a pressure change of contained gas, the elastic body being configured to be capable of holding the substrate to be processed on a substrate holding surface, wherein an outer peripheral edge of the elastic body is positioned inside an outer peripheral edge of an outermost peripheral substrate pressing part among the plurality of substrate pressing parts, the substrate holding surface fits inside a range facing the outermost peripheral substrate pressing part, and the outermost peripheral substrate pressing part faces the substrate to be processed without interposing the elastic body between the outermost peripheral substrate pressing part and the substrate to be processed.

15. The elastic body according to claim 14, wherein a material of the elastic body is at least one of silicone rubber, butyl rubber, and chloroprene rubber.

* * * * *